United States Patent [19]

van der Waal

[11] 4,065,695

[45] Dec. 27, 1977

[54] CATHODE RAY TUBE SCREEN HAVING CHARGE-RETAINING LAYER APERTURED IN REGISTRATION WITH COLOR ELEMENTS

[75] Inventor: Jan van der Waal, Eindhoven, Netherlands

[73] Assignee: U.S. Philips Corporation, New York, N.Y.

[21] Appl. No.: 653,921

[22] Filed: Jan. 30, 1976

[30] Foreign Application Priority Data

Apr. 11, 1975 Netherlands ..... 7504324

[51] Int. Cl.[2] ..... H01J 29/32; H01J 31/20

[52] U.S. Cl. ..... 313/466; 313/470

[58] Field of Search ..... 313/466, 471, 472, 408, 313/470

[56] References Cited

U.S. PATENT DOCUMENTS

| | | | |
|---|---|---|---|
| 3,814,629 | 6/1974 | Hansen et al. | 313/466 X |
| 3,858,083 | 12/1974 | Rehkopf et al. | 313/472 |

*Primary Examiner*—Robert Segal

*Attorney, Agent, or Firm*—Frank R. Trifari

[57] ABSTRACT

In a color CRT, the mislanding of electron beams due to thermal effects in the shadow mask is compensated for by means of an electron-absorbing insulating layer on the display screen, which layer has apertures which are in registration with the luminescent regions of the display screen.

2 Claims, 4 Drawing Figures

CATHODE RAY TUBE SCREEN HAVING CHARGE-RETAINING LAYER APERTURED IN REGISTRATION WITH COLOR ELEMENTS

The invention relates to a cathode ray tube for displaying coloured pictures, the tube comprising a shadow mask having a large number of apertures, a display screen having a large number of regions luminescing in different colours, and means to generate a number of electron beams, each electron beam being arranged to impinge on luminescent regions of a respective colour by means of the apertures in the shadow mask.

Such a cathode ray tube is the type of display tube conventionally used for colour television at the present time. The luminescent regions may have the form, for example, of circular dots or parallel strips. The shape and arrangement of the apertures in the shadow mask are adapted to the form of the luminescent regions. Since the apertures in the shadow mask determine where the electron beams impinge upon the display screen, it is of great importance that the shape and the position of the shadow mask relative to the display screen be accurately determined and maintained in operation so that each electron beam impinges upon luminescent regions of the correct colour. If this is not the case, so-called mislanding occurs, as a result of which serious discolouring of the displayed picture may occur. Since the shadow mask intercepts a large portion of the electron beams, a considerable quantity of thermal energy is generated in it, and consequently the shadow mask expands. This results in a radial displacement of the apertures relative to the centre of the mask, so that mislanding could occur. As is known, however, the effect of the expansion of the shadow mask can be compensated for by means of an axial displacement of the shadow mask towards the display screen. Said displacement which should depend, of course, on the temperature of the shadow mask can be obtained by means of bimetallic springs or by connecting the shadow-mask to leaf springs in such a manner that a radial expansion is automatically associated with an axial displacement along the major axis of the tube. These and similar constructions are known, but they do not compensate for a local bulge (hump) in the shadow mask nor, for example, for a greater degree of bulging at the center of the shadow mask than at the edges as a result of temperature differences between those regions.

A local bulge in the shadow mask can result from a large local generation of heat associated with a bright part of the displayed picture which is produced by large electron-beam currents. Of course, a local bulge cannot be compensated for by means of a displacement of the shadow mask as a whole without adversely effecting the alignment of other parts of the mask. Known measures to prevent mislanding in light parts of the displayed picture are therefore generally based on preventing a local bulge, for example, by dissipating the thermal energy generated in the shadow mask as rapidly as possibly. In practice said measures have nevertheless not proved to be wholly satisfactory; the prior art consequently does not provide a good solution to the problem of the discolouring of bright parts of the displayed picture.

It is the object of the invention to reduce mislanding in quite a different manner, for which purpose in a cathode ray tube of the kind mentioned in the preamble, the surface of the display screen on which the electron beams impinge comprises an electron-absorbing layer having a low electrical conductivity, said layer having apertures which are in registration with the luminescent regions.

At areas in a tube embodying the invention at which no mislanding occurs, the electron-absorbing layer having a low electrical conductivity is not hit by the electrong beams and it therefore has the same potential as the display screen. At areas in such a tube at which mislanding does occur, the layer is hit by the electron beams and it is charged negatively because it absorbs the electrons; this implies that the thickness of the layer is of the same order as the average depth of penetration of the electrons (or more), and that the layer has a secondary emission coefficient which is smaller than 1 for the relevant electrode configuration and energy of the primary electrons (for example, 25 keV). As a result of this charging, a retarding electric field is set up between the display screen and the shadow mask and deflects electrons which enter the field at an angle to the axis of the tube in a radially outward direction from the center of the display screen. This deflection results in considerable reduction of the original mislanding, as will be explained hereinafter. The electron-absorbing layer should not have too low an electrical conductivity, because the charge should leak away when the cause of the original mislanding has disappeared.

In a cathode ray tube embodying the invention and comprising a continuous, thin metal layer over the luminescent regions, the electron-absorbing layer is suitably provided on the continuous metal layer.

Good results have been obtained with a cathode ray tube embodying the invention and having an electron-absorbing layer which is at least 0.003 mm thick and which consists of aluminium oxide.

The invention will be described in greater detail with reference to the accompanying drawing, in which.

Figure 1:
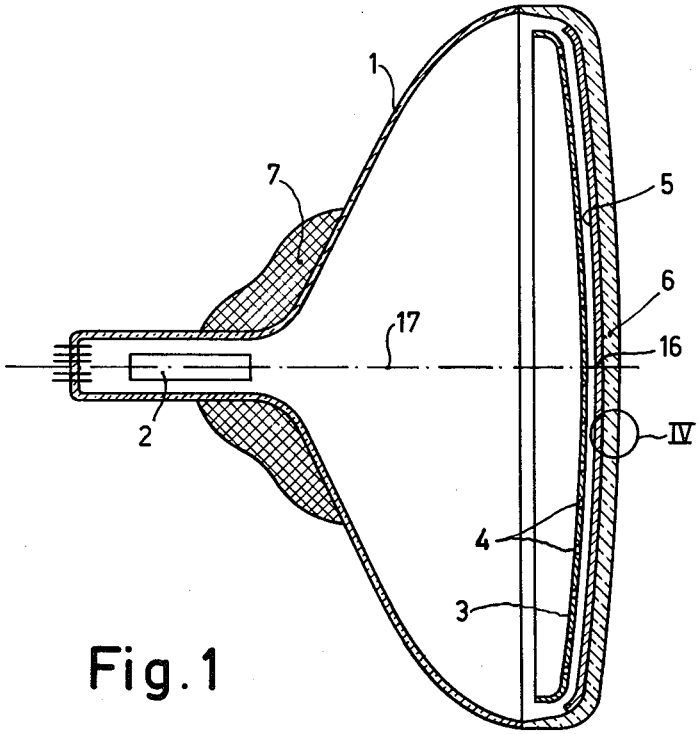
FIG. 1 is a longitudinal cross-sectional view of a cathode ray tube embodying the invention.

The cathode ray tube shown in FIG. 1 comprises in a glass envelope 1 an electron gun 2 to generate three electron beams, a shadow mask 3 having a large number of apertures 4 and a display screen 5 on a glass face plate 6. The display screen 5 will be described later in greater detail with reference to the cross-sectional view shown in FIG. 4. The tube furthermore comprises deflection coils 7 by means of which the electron beams are deflected across the display screen 5. As already noted, the apertures 4 in the shadow mask 3 determine the areas where the display screen is hit by the electron beams.

Figure 2:
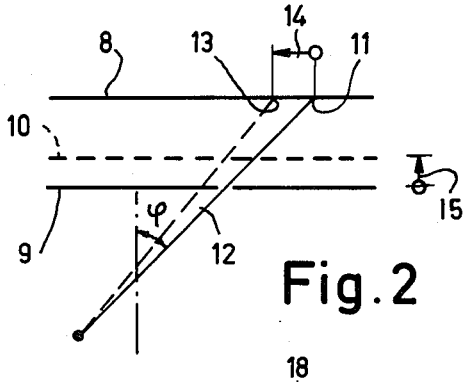
FIG. 2 is a diagrammatic figure to explain mislanding as a result of an axial displacement of the shadow mask towards the display screen.

It will now be explained with reference to FIG. 2 how mislanding of an electron beam is associated with a displacement of the relevant part of the shadow mask 3. In FIG. 2, the display screen is denoted by the line 8 and the shadow mask by the lines 9 and 10. The line 9 denotes the desired position of the shadow mask corresponding to a desired target spot 11 of the electron beam 12. The line 10 denotes the incorrect position of the relevant part of the shadow mask resulting from a local bulge (hump). The extent and direction of bulging is denoted by the arrows 15. The mislanding, denoted by arrow 14, is the displacement of the target spot of the electron beam from point 11 to point 13. The angle $\phi$ shown in FIG. 2 denotes the angle between the axis 17 of the tube (FIG. 1) and the electron beam 12 passing through a particular aperture in the shadow mask; as can be seen from the Figure, mislanding, due to local bulging of the shadow mask, which is always directed towards the display screen, takes place in the direction of the center 16 (FIG. 1) of the display screen. The mislanding denoted by the arrow 14 is situated substantially in a plane including the axis of the electron beam and the axis 17 (FIG. 1) of the tube. The larger the angle $\phi$, the larger is the mislanding with a given bulging of the shadow mask.

Figure 3:
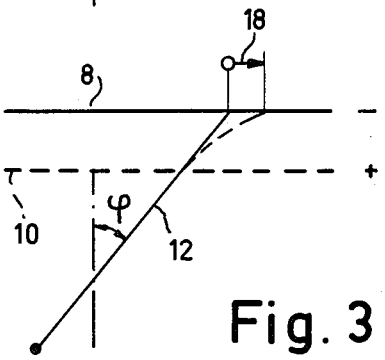
FIG. 3 is a diagrammatic figure to explain the deflection of an electron beam under the influenece of a retarding electric field between the display screen and the shadow mask.

It will now be explained with reference to FIG. 3 how a retarding electric field between the shadow mask and the display screen results in a displacement of the target spot of the electron beam in a direction opposite to the arrow 14 (FIG. 2), namely a displacement denoted by the arrow 18 away from the center 16 (FIG. 1) of the display screen. The retarding field, denoted in FIG. 3 by a minus sign (−) at the display screen 8 and by a plus sign (+) at the shadow mask 10 reduces only that component of velocity of the electrons which is at right angles to the display screen. Their component of velocity which is parallel to the display screen (the radial component) remains unchanged. As a result, the electron beam 12 follows the path shown by a dashed line, the target spot being displaced in the direction of the arrow 18.

The retarding electric field should be produced only in the case of mislanding and for that reason be generated by the electron beam itself whenever mislanding occurs. For that purpose, the invention provides a suitable form of display screen, an example of which will be described with reference to FIG. 4.

Figure 4:
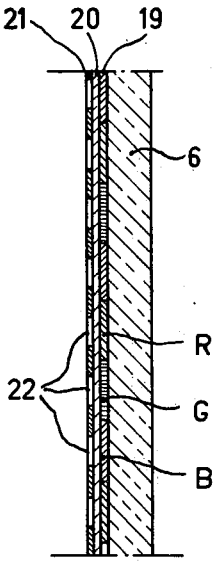
FIG. 4 is a cross-sectional view on an enlarged scale of part of the display screen of the cathode ray tube shown in FIG. 1.

As shown in FIG. 4, the glass face place 6 is coated with a luminescent layer 19 which consists of a large number of phosphor regions R, G and B luminescing in red, green and blue, respectively, and provided in known manner. A thin continuous layer 20 of aluminium is provided on the layer 19 also in a usual manner and serves inter alia to maintain the potential of the screen at a fixed value and to reflect towards the viewer light generated by the phosphor regions. An electron-absorbing layer 21 having a low electric conductivity covers the layer 20. The layer 21, which is 0.01 mm thick and consists of aluminium oxide, has apertures 22 which are in registration with those parts of the phosphor regions R, G and B which should be hit by the electron beams. Whenever and wherever mislanding occurs, the layer 21 is hit by electrons and is charged negatively so that a retarding electric field is formed between the shadow mask and the display screen, compensating for mislanding as described above.

In a practical case, a mislanding of 0.12 mm in a conventional tube was reduced to 0.05 mm in a tube embodying the invention with a retarding voltage of 1000 V. This was determined by comparison of a tube embodying the invention and a tube which was identical except that it did not comprise the layer 21. The potential difference set up between the shadow mask and the display screen is difficult to measure but was evaluated at approximately 1000 V.

The layer 21 can be provided by the following method. First, a photosensitive suspension of aluminium oxide which becomes water-insoluble on exposure to light is prepared by grinding, 300 g of fine granular aluminium oxide powder in a ball mill with 33 g of polyvinyl alcohol, 0.8 of ammonium bichromate and 1025 $cm^3$ of water for approximately 24 hours. A suitable polyvinyl alcohol is the kind which is commercially available as Mowiol 40-88.

A thin precoat consisting of a solution of 0.2 % polyvinyl alcohol in water is then provided on the aluminium layer 20.

A layer of the photosensitive suspension of aluminium oxide is provided on said precoat. Said layer is exposed three times via the shadow mask with an annular light source which is centered on the deflection point of the three electron beams as described in U.S. Pat. No. 3,152,900 and which has a light distribution such that the photosensitive suspension is exposed to light in all places except at the areas where the apertures 22 have to be formed in the layer 21 in registration with the phosphor regions R, G and B. The non-exposed parts of the layer 21 which remain soluble are then removed by a fine waterspray. If the phosphor regions R, G and B are in the form of parallel strips rather than circular dots, the said annular light source should be replaced by two parallel elongate light sources. These and similar exposure methods need no further explanation since they are known from the prior art.

In order to obtain a thick layer 21 of aluminium oxide, the method described may be repeated once, if desired.

What is claimed is:

1. A cathode-ray tube for displaying color pictures comprising a shadow mask having a large number of apertures, a display screen having a large number of regions luminescing in different colors, and electron gun means to generate a number of electron beams, each electron beam being arranged to impinge on luminescent regions of a respective color by means of the apertures in the shadow mask, said display screen being covered on the side facing said electron gun means with a continuous thin metal layer, said metal layer on the side facing said electron gun means being provided with an electron-absorbing and charge-retaining layer having a low electrical conductivity and having apertures which are in registration with the luminescent regions.

2. A cathode ray tube as claimed in claim 1, wherein the electron-absorbing layer consists of aluminium oxide and is at least 0.003 mm thick.

* * * * *